US005719016A

United States Patent [19]

Christian et al.

[11] Patent Number: 5,719,016

[45] Date of Patent: Feb. 17, 1998

[54] IMAGING ELEMENTS COMPRISING AN ELECTRICALLY CONDUCTIVE LAYER CONTAINING ACICULAR METAL-CONTAINING PARTICLES

[75] Inventors: Paul A. Christian, Pittsford; Dennis J. Eichorst, Fairport; Gerald M. Leszyk, Spencerport, all of N.Y.

[73] Assignee: Eastman Kodak Company, Rochester, N.Y.

[21] Appl. No.: 746,618

[22] Filed: Nov. 12, 1996

[51] Int. Cl.[6] ..... G03C 1/85; G03G 5/10

[52] U.S. Cl. ..... 430/530; 430/53; 430/63; 430/69; 430/201; 430/527; 503/227

[58] Field of Search ..... 430/527, 530, 430/63, 69, 201, 53

[56] References Cited

U.S. PATENT DOCUMENTS

| | | | |
|---|---|---|---|
| 4,275,103 | 6/1981 | Tsubusaki et al. | 430/67 |
| 4,394,441 | 7/1983 | Kawaguchi et al. | 430/530 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,999,276 | 3/1991 | Kuwabara et al. | 430/264 |
| 5,116,666 | 5/1992 | Konno | 428/220 |
| 5,122,445 | 6/1992 | Ishigaki | 430/530 |
| 5,294,525 | 3/1994 | Yamauchi et al. | 430/530 |
| 5,368,995 | 11/1994 | Christian et al. | 430/530 |
| 5,382,494 | 1/1995 | Kudo et al. | 430/530 |
| 5,459,021 | 10/1995 | Ito et al. | 430/527 |

FOREIGN PATENT DOCUMENTS

| | | |
|---|---|---|
| 0 616 252 | 9/1994 | European Pat. Off. . |
| 0 404 091 | 8/1995 | European Pat. Off. . |
| 57-06235 | 1/1982 | Japan . |
| 63-60452 | 3/1988 | Japan . |
| 63-98656 | 4/1988 | Japan . |
| 63-287849 | 11/1988 | Japan . |
| 1-262537 | 10/1989 | Japan . |
| 4-29134 | 5/1990 | Japan . |
| 4-97339 | 8/1990 | Japan . |
| 4-27937 | 1/1992 | Japan . |
| 4-055492 | 2/1992 | Japan . |
| WO 91/05668 | 5/1991 | WIPO . |
| WO 94/25966 | 11/1994 | WIPO . |

*Primary Examiner*—Richard L. Schilling
*Attorney, Agent, or Firm*—Carl F. Ruoff

[57] ABSTRACT

The present invention describes imaging elements which include a support, an image-forming layer and an electrically-conductive layer. The electrically conductive layer is a dispersion in a film-forming binder of acicular, crystalline single phase, conductive metal-containing particles having a cross-sectional diameter less than 0.02 μm and an aspect ratio of greater than or equal to 5:1.

34 Claims, 3 Drawing Sheets

IMAGING ELEMENTS COMPRISING AN ELECTRICALLY CONDUCTIVE LAYER CONTAINING ACICULAR METAL-CONTAINING PARTICLES

CROSS-REFERENCE TO RELATED APPLICATIONS

This application relates to commonly assigned copending application Ser. No. 08/747,480, Express Mail No. EM059243342US which is filed simultaneously herewith and hereby incorporated by reference for all that it discloses.

1. Field of the Invention

This invention relates generally to imaging elements, such as photographic, electrostatographic and thermal imaging elements and in particular to imaging elements containing electrically-conductive layers.

2. Background of the Invention

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layers can produce irregular fog patterns or static marks in the emulsion. The severity of the static problems has been exacerbated greatly by the increases in sensitivity of new emulsions, increases in coating machine speeds, and increases in post-coating drying efficiency. The charge generated during the coating process results primarily from the tendency of webs of high dielectric constant polymeric film base to charge during winding and unwinding operations (unwinding static), during transport through the coating machines (transport static), and during post-coating operations such as slitting and spooling. Static charge can also be generated during the use of the finished photographic product. In an automatic camera, the winding of roll film out of and back into the film cassette, especially in a low relative humidity environment, can result in static charging. Similarly, high speed automated film processing can result in-static charge generation. Sheet films are especially subject to static charging during removal from light-tight packaging (e.g., X-ray films).

It is generally known that electrostatic charge can be dissipated effectively by incorporating one or more electrically-conductive antistatic layers into the film structure. Antistatic layers can be applied to one or both sides of the film base as subbing layers either beneath or on the side opposite the light-sensitive silver halide emulsion layers. An antistatic layer can alternatively be applied as an outer coated layer either over the emulsion layers or on the side of the film base opposite the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most antistatic layers traditionally used for photographic applications employ ionic conductors. Electric charge is transferred in ionic conductors by the bulk diffusion of charged species through an electrolyte. Antistatic layers containing electronic conductors also have been described. Because the conductivity of electronic conductors depends predominantly on electronic mobilities rather than ionic mobilities, their observed electrical conductivity is independent of relative humidity and only slightly influenced by ambient temperature. Antistatic layers containing various conjugated polymers, conductive carbon particles or semiconductive inorganic particles have been described.

Conductive layers containing granular, nominally spherical, fine particles of crystalline semiconductive metal oxides for use in various types of imaging elements have been described previously. Numerous binary metal oxides doped with appropriate donor heteroatoms have been disclosed in prior art as sufficiently conductive to be useful in antistatic layers for photographic and electrophotographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; and 5,459,021. Suitable claimed conductive binary metal oxides include: zinc oxide, titania, tin oxide, alumina, indium oxide, silica, magnesia, zirconia, barium oxide, molybdenum trioxide, tungsten trioxide, and vanadium pentoxide. Preferred conductive metal oxide granular particles include Sb-doped tin oxide, Al-doped zinc oxide, and Nb-doped titania. Additional preferred conductive ternary metal oxides including zinc antimonate and indium antimonate have been disclosed in U.S. Pat. No. 5,368,995.

Antistatic layers comprising other electrically-conductive metal-containing non-oxide type inorganic particles such as metal borides, carbides, nitrides, and silicides dispersed in a water-soluble polymer or solvent-soluble resin as binder are disclosed in Japanese Kokai No. 04-055,492. Specific examples of preferred metal non-oxide conductive particles include $TiB_2$, $ZrB_2$, $NbB_2$, $TAB_2$, $CrB_2$, MoB, WB, $LAB_6$, ZrN, TiN, TiC, WC, $TiSi_2$, $MoSi_2$ and $WSi_2$.

The use of "fibrous" or "fibrilar" conductive materials in imaging elements has been taught or disclosed in the prior art discussed below.

A conductive backing or subbing layer for silver halide photographic films prepared by coating an aqueous dispersion of a colloidal gel of "amorphous" vanadium pentoxide preferably silver-doped vanadium-pentoxide onto a film support is described in U.S. Pat. Nos. 4,203,769 and 5,439,785. Colloidal vanadium pentoxide gel consists of entangled conductive microscopic fibrils or ribbons that are 0.005–0.01 μm wide, about 0.001 μm thick, and 0.1–1 μm in length. Conductive layers containing colloidal vanadium pentoxide exhibit low surface resistivities at very low dry weight coverages, low optical losses, and excellent adhesion to the support. However, since colloidal vanadium pentoxide dissolves in developer solution during wet processing it must be protected by a nonpermeable, hydrophobic overlying barrier layer as taught in U.S. Pat. Nos. 5,006,451, 5,284,714, and 5,366,855. When used with a conductive subbing layer, this barrier layer must be overcoated with a tie layer to promote adhesion to a hydrophilic overlying layer. Alternatively, a film-forming sulfopolyester latex or a polyesterionomer binder can be combined with colloidal vanadium pentoxide in the conductive layer to minimize degradation during wet processing as taught in U.S. Pat. Nos. 5,427,835 and 5,360,706.

Conductive subbing and backing layers for silver halide photographic films containing "short fiber", "needle-like" or "fibrous" conductive materials have been described in U.S. Pat. Nos. 5,122,445 and 4,999,276, European Application No. 404,091; and Japanese Kokai Nos. 04-27937, 04-29134, and 04-97339. One such example is a fibrous nonconductive $TiO_2$ particle coated with a layer of conductive metal oxide fine particles as described in Japanese Kokai No. 59-06235. The preferred fibrous conductive particles disclosed in this Kokai exhibited average lengths of ≦25 μm, diameters of ≦0.5 μm, and a length to diameter ratio of ≦3.

Other photographic films in which conductive $K_2Ti_6O_{13}$ fibers were incorporated in subbing, backing or surface protective layers at dry coverages of 0.1–10 g/m$^2$ are described in Japanese Kokai No. 63-98656. A laser scanner film containing conductive $K_2Ti_6O_{13}$ fibers 0.05–1 μm in diameter and 1–25 μm in length dispersed in the emulsion layer is described in Japanese Kokai No. 63-287849.

A silver halide photographic film comprising a conductive backing or subbing layer containing fibrous $TIO_2$ particles surface-coated with a thin layer of conductive antimony-doped $SnO_2$ particles and a transparent magnetic recording layer has been taught in a Comparative Example in U.S. Pat. No. 5,459,021. The average size of said fibrous conductive particles was about 0.2 μm in diameter and 2.9 μm in length. Further, said fibrous particles exhibit a crystallite size of 22.3 nm. Such fibrous conductive particles are commercially available from Ishihara Sangyo Kaisha under the tradename "FT-2000". However, conductive layers containing these fibrous particles were disclosed to exhibit fine cracks which resulted in decreased conductivity, increased haze, and decreased adhesion compared to similar layers containing granular conductive tin oxide particles.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing antistatic protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often useful in the electrode layer of electrostatographic imaging elements.

Conductive layers for electrostatic recording films containing conductive fibrous metal oxides are described in U.S. Pat. No. 5,116,666 and Japanese Kokai No.63-60452. The conductive fibrous materials are commercially available from Otsuka Chemical under the tradename Dentall WK200B. These fibrous particles consist of a thin conductive Sb-doped tin oxide layer deposited on the surface of a nonconductive $K_2Ti_6O_{13}$ core particle. An electrostatic recording paper with a conductive layer containing conductive $K_2Ti_6O_{13}$ fibers has also been described in Japanese Kokai No. 02-307551.

Conductive coatings for photographic papers containing acicular $TiO_2$ particles or $K_2Ti_6O_{13}$ fibers coated with conductive Sb-doped $SnO_2$ particles have been described in European Patent Application No. 616,252 and Japanese Kokai No. 01-262537.

Thermal media with conductive layers containing fibrous conductive metal oxide particles 0.3 μm in diameter and 10 μm in length are described in Japanese Kokai No. 07-295146. Thermographic media coated with ZnO, $Si_3N_4$ or $K_2Ti_6O_{13}$ conductive fibers are described in World Patent Application No. 91-05668.

An electrophotographic support containing rod-shaped conductive ZnO particles is described in World Patent Application No. 94-25966.

As indicated hereinabove, the prior art on electrically-conductive layers useful for imaging elements is extensive and a very wide variety of electroconductive materials have been disclosed. However, there is still a critical need in the art for improved electrically-conductive layers which can be used in a wide variety of imaging elements, which can be manufactured at a reasonable cost, which are resistant to the effects of relative humidity change, which are durable and abrasion-resistant, which do not exhibit adverse sensitometric or photographic effects, and which are substantially insoluble in solutions with which the imaging element comes in contact, such as the processing solutions used for silver halide photographic films. It is toward the objective of providing improved electrically-conductive layers that more effectively meet the diverse needs of imaging elements, especially of silver halide photographic films, than those of the prior art that the present invention is directed.

SUMMARY OF THE INVENTION

The present invention is an imaging element which includes a support, an image-forming layer, and an electrically-conductive layer. The electrically-conductive layer contains acicular, crystalline, single phase conductive metal-containing particles having a cross-sectional diameter less than or equal to 0.02 μm and an aspect ratio greater than or equal to 5:1 dispersed in a film-forming polymeric binder.

Figure 1:
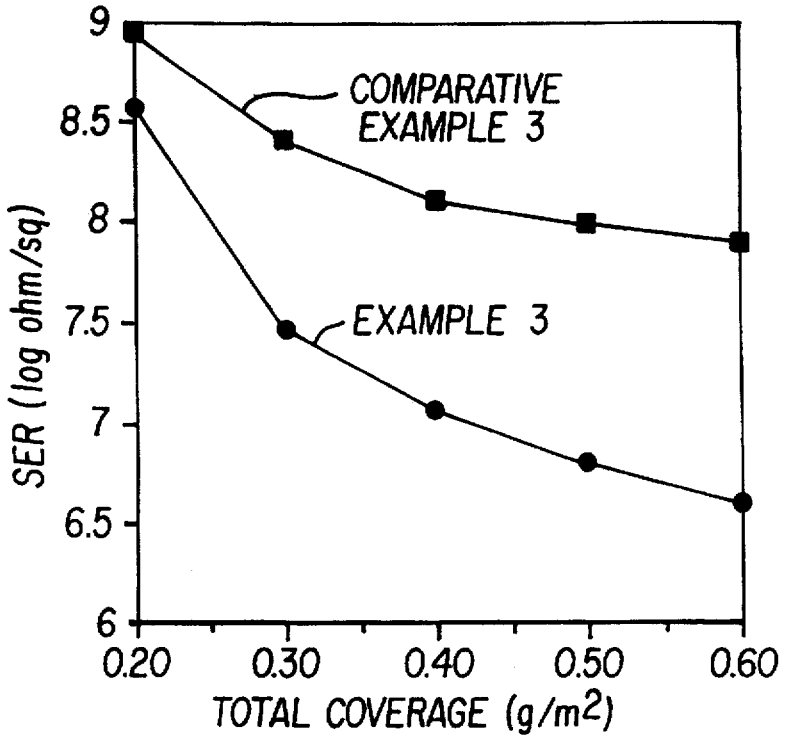
FIG. 1 is a plot showing the relationship between the surface electrical resistivity (SER) and the total dry weight coverage for various conductive layers.

For a better understanding of the present invention together with other objects, advantages and capabilities thereof, reference is made to the following description and claims in connection with the above described drawings.

DETAILED DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the number and kinds of auxiliary layers that are included in the elements. In particular, photographic elements can be still films, motion picture films, x-ray films, graphic arts films, paper prints or microfiche. They can be black-and-white elements, color elements adapted for use in a negative-positive process, or color elements adapted for use in a reversal process. It is also specifically contemplated to use the antistatic layer according to the present invention in small format film as described in *Research Disclosure*, Item 36230 (June 1994).

Photographic elements can comprise any of a wide variety of supports. Typical supports include cellulose nitrate film, cellulose acetate film, poly(vinyl acetal) film, polystyrene film, poly-(ethylene terephthalate) film, poly(ethylene naphthalate) film and copolymers thereof, polycarbonate film, glass plates, metal plates, reflecting supports such as paper, polymer-coated paper, and the like. The image-forming layer or layers of the element typically comprise a radiation-sensitive agent, e.g., silver halide, dispersed in a hydrophilic water-permeable colloid. Suitable hydrophilic colloids include both naturally-occurring substances such as proteins, for example, gelatin, gelatin derivatives, cellulose derivatives, polysaccharides such as dextran, gum arabic, starch derivatives and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly (ethylene terephthalate) as described in U.S. Pat. No. 3,245,833, (f) electrically conducting salts such as described in U.S. Pats. No. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure*, June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal*, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography*, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non- photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an anti-static layer. The requirements for a useful electrically-conductive layer in an imaging environment are extremely demanding and thus the art has long sought to develop improved electrically-conductive layers exhibiting the necessary combination of physical, optical and chemical properties.

This invention provides a transparent electrically-conductive layer for use in an imaging element. The transparent electrically-conductive layer comprises electrically-conductive, acicular, metal-containing particles dispersed in one or more suitable film-forming polymeric binder(s). This electrically-conductive layer commonly is used as an anti-static layer to dissipate electrostatic charge. In addition to providing static protection, it also can serve as a transparent electrode in an image forming process. The electroconductive properties provided by the conductive layer of this invention are essentially independent of relative humidity and persist even after exposure to aqueous solutions with a wide range of pH values (e.g., $2 \leqq pH \leqq 13$) such as are encountered in the wet-processing of silver halide photographic films. Thus, it is not generally necessary to provide a protective overcoat overlying the conductive layer, although optional protective layers may be present.

The conductive layer of this invention may be present as a backcoating, subbing or protective overcoating layer on either or both sides of the support or may be integrated into the support. In the case of a silver halide imaging element, the function of the conductive layer also may be incorporated directly into the sensitized emulsion layer(s).

The principle advantage of this invention derives from the use of a specific class of acicular, conductive metal-containing particles as compared to granular, conductive metal-containing particles of the prior art. The enhanced efficiency of conductive network formation by acicular particles relative to comparable cross-sectional diameter granular particles permits the preparation of more conductive layers at dry coverages comparable to those used for granular conductive particles of the prior art, which is desirable for imaging processes requiring electrodes. Especially for the case of silver halide imaging elements, this enhanced efficiency permits the use of substantially lower dry weight coverages of the acicular conductive metal-containing particles to achieve a given level of conductivity for the conductive layers, or alternatively, a lower volume fraction of the conductive particles relative to polymeric binder. One potential benefit is that the thickness of the coated conductive layer can be decreased. This results in decreased optical losses and can lead to decreased tool wear and dirt generation in finishing operations during manufacturing. Further, the use of a larger volume fraction of polymeric binder in the conductive layer results in improved adhesion to underlying and overlying layers as well as improved cohesion within the conductive layer itself.

The acicular conductive metal-containing particles used in accordance with this invention are single phase, crystalline, and have nanometer-size dimensions. Suitable dimensions for the acicular particles are less than 0.05 μm in diameter and less than 1 μm in length, preferably less than 0.02 μm in diameter and less than 0.5 μm in length, more preferably less than 0.01 μm in diameter and less than 0.15 μm in length. These dimensions tend to minimize optical losses of the coated layers due to Mie scattering. An aspect ratio of greater than or equal to 5:1 (length/diameter) is preferred and an aspect ratio of greater than 10:1 is more preferred. An increase in aspect ratio results in an improvement in volumetric efficiency of conductive network formation.

One particular class of acicular conductive particles comprises acicular electrically-conductive metal containing particles. Preferred metal-containing particles are semiconductive metal oxide particles. Acicular conductive metal oxide particles suitable for use in conductive layers of this invention are those which exhibit a specific (volume) resistivity of less than $1\times10^5$ ohm-cm, more preferably less than $1\times10^3$ ohm-cm, and most preferably, less than $1\times10^2$ ohm-cm. Another physical property used to characterize crystalline metal oxide particles is the average x-ray crystallite size. The concept of crystallite size is described in detail in U.S. Pat. No. 5,484,694 and references cited therein. Transparent conductive layers containing semiconductive antimony-doped tin oxide granular particles exhibiting a preferred crystallite size of less than 10 nm are taught in U.S. Pat. No. 5,484,694 to be particularly useful for imaging elements. Similarly, photographic elements comprising antistatic layers containing conductive granular metal oxide particles with average crystallite sizes ranging from 1 to 20 nm, preferably from 1 to 5 nm, and more preferably from 1 to 3.5 nm are claimed in U.S. Pat. No. 5,459,021. Advantages to using metal oxide particles with small crystallite sizes are disclosed in U.S. Pat. Nos. 5,484,694 and 5,459,021 including the ability to be milled to a very small size without significant degradation of electrical performance, ability to produce a specified level of conductivity at lower weight loadings and/or dry coverages, as well as decreased optical denisity, decreased brittleness, and cracking of conductive layers containing such particles.

One example of a suitable acicular semiconductive metal oxide is an electroconductive tin oxide powder available under the tradename "FS-10P" from Ishihara Techno Corporation. This tin oxide comprises acicular particles of single phase, crystalline tin oxide which is doped with antimony. The specific (volume) resistivity of this material is about 50 ohm-cm measured as a packed powder using a DC two-probe test cell similar to that described in U.S. Pat. No. 5,236,737. The mean dimensions of these acicular particles as determined from image analysis of transmission electron micrographs are approximately 0.01 μm in diameter and 0.1 μm in length with an average aspect ratio of about 10:1. An x-ray powder diffraction analysis of this acicular tin oxide has confirmed that is single phase and highly crystalline. The x-ray crystallite size of this acicular antimony-doped tin oxide was determined to be 21.0 nm.

Additional examples of acicular metal-containing particles include metal carbides, nitrides, silicides and borides. Other suitable examples of acicular conductive metal oxides particles include tin-doped indium sesquioxide, niobium-doped titanium dioxide, and the alkali metal bronzes of tungsten, molybdenum or vanadium.

Acicular metal oxide particles described in the prior art typically consist of a nonconductive core particle with a conductive outer shell. This conductive outer shell can be prepared by the chemical precipitation or vapor deposition of conductive fine particles onto the surface of the nonconductive core particle. Several serious deficiencies are manifested when such core/shell-type conductive particles are used in conductive layers for imaging elements. Because it is necessary to prepare the core particle and then coat it with fine conductive particles in a separate operation, the diameter of the resulting composite conductive particle is typically 0.1–0.5 μm or larger. The lengths of these particles typically range from 1–5 μm. These large particle sizes result in increased light scattering and hazy coatings that are not acceptable for imaging elements. Further, in the process of mechanically dispersing these core/shell-type particles, the thin conductive shells are often abraded from the surface resulting in decreased conductivity for coated layers containing these damaged particles. In addition, the large overall particle size results in the formation of fine cracks in the coated layers that produce decreased wet and dry adhesion to the support and overlying or underlying layers. This cracking also leads to a decrease in the cohesion of the conductive layer itself that can result in increased dust formation during finishing operations. However, these deficiencies are notably absent from conductive layers of this invention.

The small average dimensions of suitable acicular conductive metal-containing particles of this invention minimize light scattering which would result in reduced optical transparency of the conductive layers. The relationship between the size of a nominally spherical particle, the ratio of its refractive index to that of the medium in which it is incorporated, the wavelength of the incident light, and the light scattering efficiency of the particle is described by Mie scattering theory (G. Mie, *Ann. Physik.*, 25, 377(1908)). A discussion of this topic as it is relevant to photographic applications has been presented by T. H. James ("The Theory of the Photographic Process", 4th ed, Rochester: EKC, 1977). In the case of high refractive index Sb-doped tin oxide granular particles of the prior art coated in a thin layer with a typical gelatin system, it is necessary to use particles with an average diameter less than about 0.1 μm in order to limit the scattering of light at a wavelength of 550 nm to less than about 10 percent. For shorter wavelength light, such as the ultraviolet light used to expose daylight insensitive graphic arts films, granular particles less than about 0.05 μm in diameter are preferred.

In addition to ensuring transparency of the conductive layers, the small average dimensions of the acicular conductive metal oxide particles of this invention promote the formation of a multitude of interconnected chains or networks of conductive particles which in turn provide a multiplicity of electrically-conductive pathways in thin coated layers. The high aspect ratio of such acicular particles results in greater efficiency of conductive network formation compared to nominally spherical conductive particles of comparable cross-sectional diameter. This permits lower volume fractions of conductive acicular particles relative to polymeric binder to be used in the coated layers to obtain effective levels of electrical conductivity.

It is an especially important feature of this invention that it permits the achievement of high levels of electrical conductivity with the use of relatively low volume fractions of acicular conductive metal oxide particles. Accordingly, in the imaging elements of this invention, the acicular conductive metal oxide particles can constitute about 2 to 70 volume percent of the electrically-conductive layer. For the acicular Sb-doped tin oxide particles described hereinabove, this corresponds to tin oxide to polymeric binder weight ratios of from approximately 1:9 to 19:1. Use of significantly less than about 2 volume percent of the acicular conductive metal oxide particles will not provide a useful level of electrical conductivity for coated layers. On the other hand, use of significantly more than 70 volume percent of the acicular conductive metal oxide particles defeats several of the objectives of this invention in that it results in reduced transparency and increased haze due to scattering losses, diminished adhesion between the electrically-conductive layer and the support as well as underlying and/or overlying layers, and decreased cohesion of the conductive layer itself. When the conductive layers of this invention are to be used as electrodes in imaging elements, the acicular conductive metal oxide particles preferably should constitute 40 to 70 volume percent of the layer in order to obtain a suitable level of conductivity. When used as antistatic layers, it is especially preferred to incorporate the acicular conductive metal oxide particles in an amount of from about 5 to 50 volume percent of the electrically-conductive layer. The use of less than 50 volume percent of acicular conductive metal oxide particles results in increased transparency, decreased haze, and improved adhesion to underlying and overlying layers as well as cohesion of the conductive layer. Further, a lower metal oxide particle fraction may lead to decreased tool wear and decreased dirt generation in finishing operations.

Binders suitable for use in conductive layers containing acicular conductive metal oxide particles include: water soluble film-forming hydrophilic polymers such as gelatin, gelatin derivatives, maleic acid anhydride copolymers; cellulose derivatives such as carboxymethyl cellulose, hydroxyethyl cellulose, hydroxypropyl methylcellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of various polyurethanes or polyesterionomers. Preferred binders include gelatin, aqueous dispersed polyurethanes, polyesterionomers, cellulose derivatives, and vinylidene-containing copolymers.

Solvents useful for preparing dispersions and coatings of acicular conductive metal oxide particles include: water; alcohols such as methanol, ethanol, propanol, isopropanol, n-butanol, isobutanol and methylcyclohexanol; ketones such as acetone, methylethyl ketone, cyclohexanone, tetrahydrofuran, isophorone and methylisobutyl ketone; esters such as methyl acetate, ethyl acetate, butyl acetate, isobutyl acetate, isopropyl acetate and ethyl lactate; ethers such as ethyl ether and dioxane; glycol ethers such as methyl cellusolve, ethyl cellusolve, glycol dimethyl ethers, and ethylene glycol; aromatic hydrocarbons such as benzene, toluene, xylene, cresol, chlorobenzene, styrene, and dichlorobenzene; chlorinated hydrocarbons such as methylene chloride, ethylene chloride, carbon tetrachloride, chloroform and ethylene chlorohydrin; and others such as N,N-dimethylformamide and hexane, and mixtures thereof. Preferred solvents include water, alcohols, and acetone.

In addition to binders and solvents, other components that are well known in the photographic art may also be present in the conductive layer. These additional components include: surfactants including fluorosurfactants, dispersing and coating aids, thickeners, crosslinking agents or hardeners, soluble and/or solid particle dyes, co-binders, antifoggants, biocides, matte beads, lubricants, and others.

Dispersions of acicular conductive metal oxide particles in a suitable solvent can be prepared in the presence of appropriate levels of dispersing aids or optional co-binders by any of various mechanical stirring, mixing, homogenization or blending processes well-known in the art of pigment dispersion and paint making.

Dispersions of acicular conductive metal oxide particles formulated with binders and additives can be coated onto a variety of photographic supports. Typical photographic film supports include cellulose nitrate film, cellulose acetate film, cellulose acetate butyrate, cellulose acetate propionate, poly (vinyl acetal) film, poly(carbonate) film, poly(styrene) film, poly(ethylene terephthalate) film, poly(ethylene naphthalate) film, polyethylene terephthalate or polyethylene naphthalate having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Preferred photographic film supports are cellulose acetate, poly(ethylene terephthalate), and poly (ethylene naphthalate) and most preferably that the poly (ethylene naphthalate) be prepared from 2,6-naphthalene dicarboxylic acids or derivatives thereof. Photographic film supports can be either transparent or opaque depending upon the application. Transparent film supports can be either colorless or colored by the addition of a dye or pigment. Photographic film supports can be surface-treated by various processes including corona discharge, glow discharge, UV exposure, flame treatment, e-beam treatment, solvent washing, and treatment with an adhesion-promoting agent including dichloro- and trichloro-acetic acid, phenol derivatives such as resorcinol and p-chloro-m-cresol, or overcoated with adhesion-promoting primer or tie layers containing polymers such as vinylidene chloride-containing copolymers, butadiene-based copolymers, glycidyl acrylate or methacrylate containing copolymers, maleic anhydride containing copolymers, condensation polymers such as polyesters, polyamides, polyurethanes, polycarbonates, mixtures and blends thereof, and the like.

Other supports for imaging elements which may be transparent or opaque include glass plates, metal plates, reflective supports such as paper, polymer-coated paper, pigment containing polyesters and the like. Suitable paper supports include polyethylene-, polypropylene-, and ethylene-butylene copolymer-coated or laminated paper and synthetic papers.

The formulated dispersions containing acicular metal oxide particles can be applied to the aforementioned film or paper supports by any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, and other coating methods well known in the art.

The electrically-conductive layer of this invention can be applied to the support at any suitable coverage depending on the particular requirements of the type of imaging element involved. For silver halide photographic films, preferred coverages of acicular antimony-doped tin oxide in the conductive layer typically include dry coating weights in the range of from about 0.005 to about 1 g/m$^2$. More preferred coverages are in the range of about 0.01 to 0.5 g/m$^2$.

The electrically-conductive layer of this invention typically has a surface resistivity of less than $1\times10^{10}$ ohms/square, preferably less than $1\times10^{9}$ ohms/square, and more preferably less than $1\times10^{8}$ ohms/square.

Conductive layers of this invention can be applied to a support in any of various configurations depending upon the requirements of the specific imaging element. In a photographic imaging element, for example, the conductive layer can be applied as a subbing layer or tie layer on either side or both sides of the film support. When a conductive layer containing acicular metal oxide particles is applied as a subbing layer under a sensitized emulsion layer, it is not necessary to apply any intermediate layers such as barrier layers or adhesion promoting layers between it and the sensitized emulsion layer, although they can optionally be present. In another type of photographic element, a conductive subbing layer is applied to only one side of the support and sensitized emulsion layers coated on both sides of the support. In the case of a photographic element that contains a sensitized emulsion layer on one side of the support and a pelloid layer containing gelatin on the opposite side of the support, the conductive layer can be coated either under the sensitized emulsion layer or under the pelloid as part of a multi-component curl-control layer or on both sides of the support. Additional optional layers can be present as well. In yet another type of photographic element, a conductive subbing layer can be applied either under or over a gelatin subbing layer containing an antihalation dye or pigment. Alternatively, both antihalation and antistatic functions can be combined in a single layer containing acicular conductive particles, antihalation dye, and a binder. This hybrid layer is typically coated on the same side of the support as the sensitized emulsion layer. The conductive layer also can be used as the outermost layer of an imaging element, for example, as a protective layer overlying an image-forming layer. Alternatively, a conductive layer also can function as an abrasion-resistant backing layer applied on the side of the support opposite to the image-forming layer. Other addenda, such as polymer lattices to improve dimensional stability, hardeners or cross-linking agents, surfactants, and various other well-known additives can be present in any or all of the above mentioned layers.

Imaging elements comprising electrically-conductive layers containing acicular metal-containing particles that are useful for other specific imaging applications such as color negative films, color reversal films, black-and-white films, color and black-and-white papers, electrographic media, dye-receiving elements used in thermal dye transfer imaging systems, laser toner fusion media, etc., can also be prepared by the procedures described hereinabove.

The present invention is further illustrated by the following examples of its practice. However, the scope of this invention is by no means restricted to these specific illustrative examples.

EXAMPLE 1

An antistatic coating formulation comprising electrically-conductive, acicular, crystalline, single-phase antimony doped tin oxide particles dispersed in water with a polyurethane binder dispersion, dispersants, coating aids, crosslinkers, and the like as optional additives was applied using a coating hopper to a moving web of polyethylene terephthalate that had been undercoated with a primer layer comprising a terpolymer latex of acrylonitrile, vinylidene chloride, and acrylic acid. The coating formulation is given below:

| Component | Weight % (dry) | Weight % (wet) |
|---|---|---|
| acicular conductive $SnO_2$* | 76.37 | 0.965 |
| polyurethane binder (W-236)+ | 19.09 | 0.241 |
| dispersant (Dequest 2006)@ | 1.91 | 0.024 |
| wetting aid (Triton X-100)# | 2.63 | 0.033 |
| water | 0.00 | (balance) |

*FS-10P, Ishihara Techno Corp.
+Witcobond W-236, Witco Corp.
@Dequest 2006, Monsanto Chemical Co.
#Triton X-100, Rohm & Haas The antistatic formulation was coated at various wet coverages ranging from 7.5 to 30 cm$^3$/m$^2$, which correspond to nominal total dry coverages of 0.10 to 0.40 g/m$^2$. The surface electrical resistivity (SER) of the coated layers was measured at nominally 50% relative humidity and after conditioning at 20% relative humidity for 24 hours using a two-point probe DC method as described in U.S. Pat. No. 2,801,191. Total optical and ultraviolet densities ($D_{min}$) were measured using a X-Rite Model 361T densitometer at 530 nm and 380 nm respectively. The optical and ultraviolet densities of the support were subtracted from the raw measurements to give Δ UV and Δ ortho $D_{min}$ values which correspond to the contribution of the antistatic layer only. Adhesion of the antistatic layer to the support was evaluated by scribing a small cross-hatched region into the coating with a razor blade. A piece of high tack adhesive tape was placed over the scribed region and quickly removed from the coating. The relative amount of coating removed is a qualitative measure of the adhesion of the coating to the support. In all cases, the antistatic layer exhibited excellent dry adhesion. Surface resistivity values, adhesion results, Δ ortho and Δ UV $D_{min}$ values are given in Table 1 for the Example 1 and Comparative Example 1 conductive layers.

Examples 1a–c demonstrate that antistatic layers containing acicular conductive antimony-doped tin oxide particles of this invention exhibit excellent conductivity and excellent adhesion to polymeric supports useful for photographic imaging elements. Furthermore, the surface electrical resistivity is essentially independent of relative humidity.

COMPARATIVE EXAMPLE 1

An antistatic coating formulation was prepared in a manner identical to that described in Example 1 except that a granular conductive antimony-doped tin oxide was substituted for the acicular antimony-doped tin oxide of this invention. A suitable granular antimony-doped tin oxide, as taught in U.S. Pat. No. 5,484,694, has an antimony doping level of greater than 8 atom percent, an x-ray crystallite size less than 100 Å, and an average primary particle diameter less than about 15 nm. The granular conductive tin oxide used herein is commercially available from Dupont Specialty Chemicals under the tradename ZELEC ECP 3010XC. The ECP 3010XC product has an antimony doping level of about 10.5 atom percent, x-ray crystallite size of 50–75 Å, and an average primary particle diameter after attrition milling of about 6–8 nm. The antistatic coating formulation was applied to a support as in Example 1 to obtain nominal dry coverages ranging from 0.10 to 0.40 g/m$^2$. The results in Table 1 demonstrate that coatings containing acicular conductive tin oxide particles of this invention have significantly lower SER values than those containing a granular conductive tin oxide at equivalent coverages. Further, greatly enhanced conductivity is achieved without an appreciable difference in haze and optical or UV density.

EXAMPLE 2

In a manner similar to Example 1b, an antistatic layer containing acicular conductive tin oxide of this invention was applied to a polyethylene naphthalate film support which had been previously surface-treated by a glow discharge treatment in an oxygen atmosphere. The antistatic layer was coated as in Example 1 to obtain 0.20 g/m$^2$ nominal total dry coverage. This antistatic layer exhibited excellent adhesion to the support and excellent conductivity. This Example demonstrates that the present invention is useful with a variety of polymeric support materials and can be used in combination with alternative surface-treatment methods avoiding the use of polymeric primer or tie layers.

Comparative Example 2

An antistatic coating was prepared in a manner similar to Example 1 using an "amorphous" semiconductive silver-doped vanadium pentoxide gel as taught in U.S. Pat. No. 4,203,769 dispersed with a polyurethane latex binder. The ratio of binder to vanadium pentoxide used was 97/3 and the total dry coverage was about 0.27 g/m$^2$. As shown in Table 1 antistatic coatings containing acicular, crystalline, conductive metal oxides and antistatic coatings containing "amorphous" semiconductive vanadium pentoxide have similar SER, Δ UV $D_{min}$ and Δ ortho $D_{min}$ values. However, as discussed hereinabove, it is well known that high aspect ratio, "amorphous", conductive vanadium pentoxide does not remain conductive after wet processing in standard photographic developing solutions without a protective nonpermeable, hydrophobic barrier layer.

TABLE 1

| Ex. No. | total dry coverage (g/m$^2$) | adhesion | Δ UV $D_{min}$ | Δ ortho $D_{min}$ | SER @ 50% RH (log ohm/square) | SER @ 20% RH (log ohm/square) |
|---|---|---|---|---|---|---|
| 1a | 0.10 | Excellent | 0.011 | 0.003 | 8.0 | 8.5 |
| 1b | 0.20 | Excellent | 0.016 | 0.007 | 6.8 | 7.2 |
| 1c | 0.40 | Excellent | 0.023 | 0.007 | 6.1 | 6.9 |
| C-1a | 0.10 | Excellent | 0.012 | 0.005 | 9.1 | 9.1 |
| C-1b | 0.20 | Excellent | 0.009 | 0.010 | 8.2 | 8.4 |
| C-1c | 0.40 | Excellent | 0.020 | 0.006 | 7.6 | 7.5 |
| 2 | 0.20 | Excellent | 0.015 | 0.005 | 7.2 | 7.7 |
| C-2 | 0.27 | Excellent | 0.011 | 0.007 | 8.4 | 7.7 |

EXAMPLE 3–5

Coating formulations were prepared in a manner similar to that described in Example 1, using additional types of polymeric binders and varying weight ratios of acicular tin oxide particles to polymeric binder. Formulations for Examples 3a–e comprise the acicular tin oxide particles of this invention dispersed in water with a terpolymer latex of acrylonitrile, vinylidene chloride, and acrylic acid as a binder at a weight ratio of 75/25. Coating formulations for Examples 4a–e comprise the acicular tin oxide particles of this invention dispersed in water with a polyesterionomer binder available commercially from Eastman Chemicals under the tradename AQ55D at a weight ratio of 65/35. Formulations for Examples 5a–e comprise the acicular tin oxide particles of this invention dispersed in water with a cellulose derivative binder at a weight ratio of 85/15. The cellulose derivative was hydroxypropyl methylcellulose, available commercially from Dow Chemical Company under the tradename METHOCEL E4M. Antistatic layers were prepared using the indicated formulations by coating to give nominal total dry coverages of 0.20, 0.30, 0.40, 0.50 and 0.60 g/m$^2$ (a–e, respectively). The SER values for these antistatic layers containing the acicular tin oxide particles of this invention are compared with those for layers containing granular conductive tin oxide particles at comparable dry coverages and weight ratios in FIGS. 1–3.

The above Examples demonstrate that the acicular conductive metal oxides of this invention can be readily dispersed in a variety of polymeric binders. Antistatic layers prepared from these dispersions exhibit excellent conductivity, adhesion, and transparency.

Comparative Examples 3–5

Figure 2:
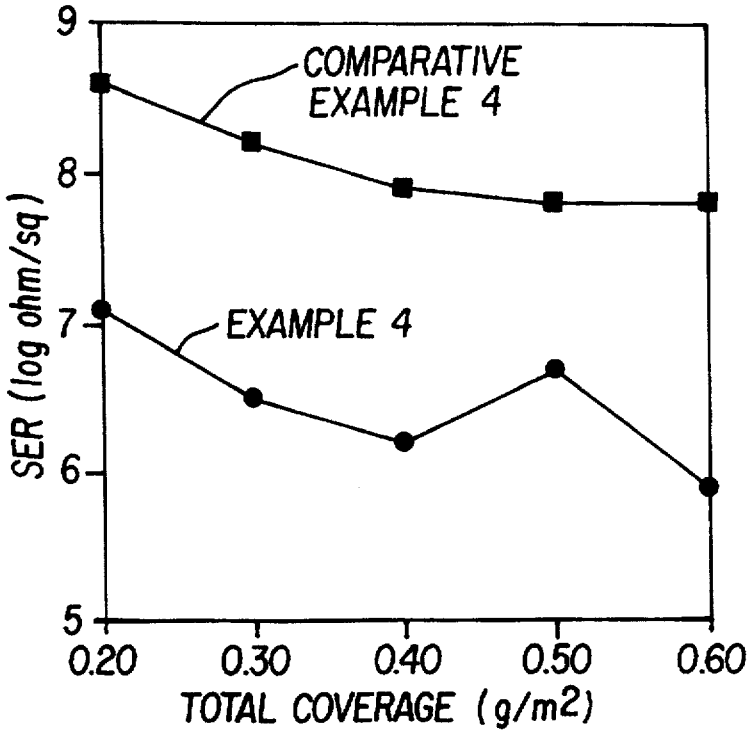
FIG. 2 is a plot showing the relationship between the surface electrical resistivity and the total dry weight coverage for various conductive layers.
Figure 3:
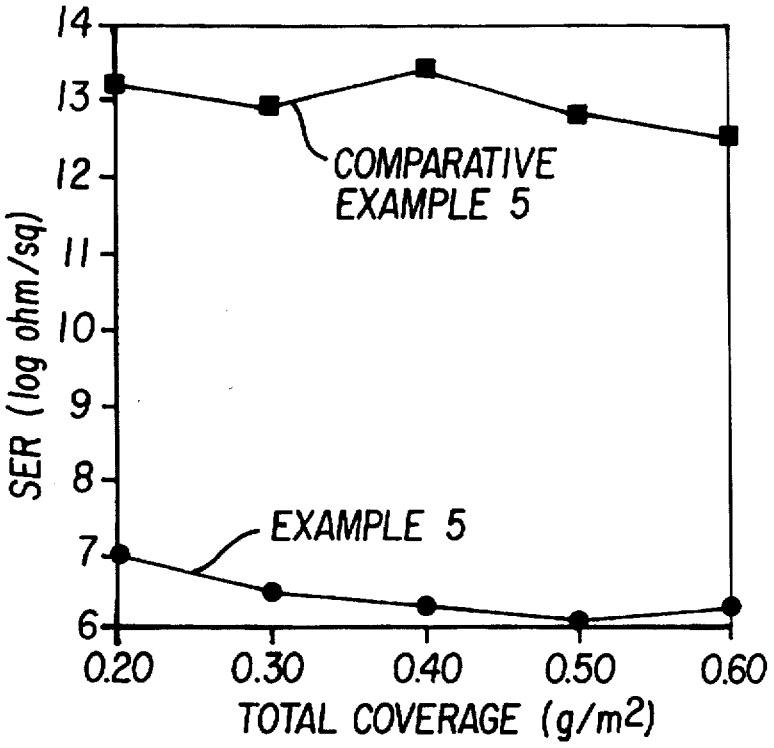
FIG. 3 is a plot showing the relationship between the surface electrical resistivity and the total dry weight coverage for various conductive layers.
Figure 4:
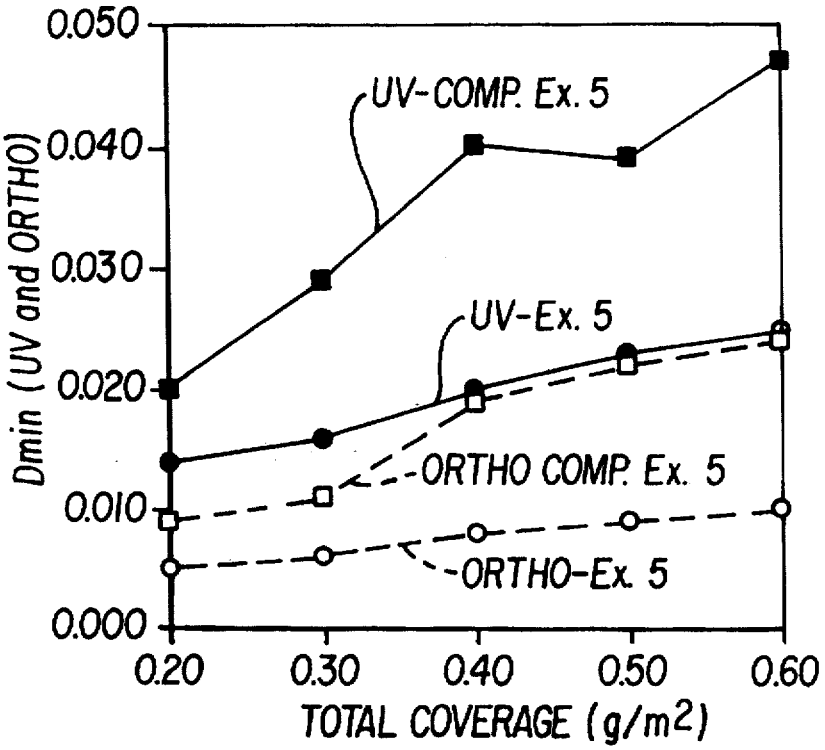
FIG. 4 is a plot showing the relationship between the optical loss properties and the total dry weight coverages for various conductive layers.

The conductive layers for Comparative Example 3 were prepared in a manner identical to that used to prepare the antistatic layers described in Example 3 except granular zinc antimonate particles as described in U.S. Pat. No. 5,368,995 were substituted for the acicular tin oxide particles. The coatings of Comparative Examples 4 and 5 were prepared similarly to those of Examples 4 and 5 except granular conductive tin oxide particles as described in Comparative Example 1 were substituted for the acicular tin oxide particles. Comparisons of the antistatic performance of layers containing the acicular materials of this invention and that of similarly prepared layers using conductive granular particles of prior art are depicted in FIGS. 1–3. In all cases, the acicular conductive tin oxide particles of the present invention produce conductive layers with significantly lower SER values than the corresponding layers containing granular conductive zinc antimonate or tin oxide particles. In addition to improved conductivity, the use of acicular conductive tin oxide particles in Example 5 resulted in improved coatability relative to Comparative Example 5. The Δ UV and Δ ortho $D_{min}$ values are quite similar (within 0.005) for both acicular and granular tin oxide layers for both terpolymer latex and polyesterionomer binders. However, as shown in FIG. 4, the layers containing the acicular tin oxide particles of this invention exhibited substantially lower optical losses with the cellulose derivative binder than corresponding layers containing granular tin oxide particles.

EXAMPLES 6–11 AND COMPARATIVES EXAMPLES 6–11

Figure 5:
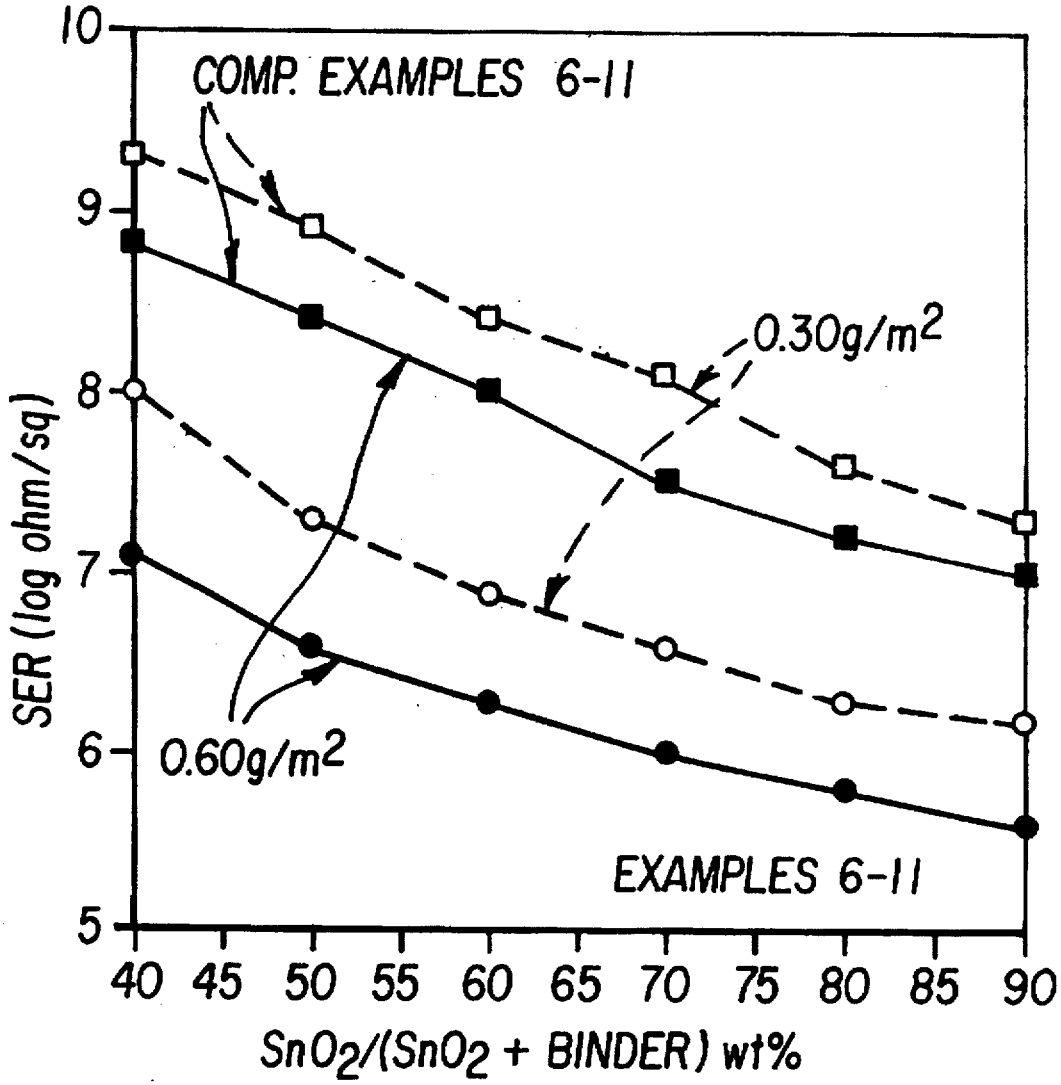
FIG. 5 is a plot showing the relationship between the surface electrical resistivity and the weight percent of conductive particles in various conductive layers.

A series of coating formulations were prepared in a manner similar to that described in Example 1 by varying the weight ratio of acicular tin oxide/binder from 90/10 to 40/60. These coating formulations were applied at various wet coverages to produce conductive layers with nominal total dry coverages ranging from 0.60 g/m$^2$ (Examples 6–11a) to 0.30 g/m$^2$ (Examples 6–11b). Similarly, conductive layers for Comparative Examples 6–11 were prepared by substituting granular tin oxide for the acicular tin oxide of this invention. The SER values for the resulting layers are compared in FIG. 5 for the 0.30 and 0.60 g/m$^2$ values of nominal total dry coverage. Generally, the layers containing the acicular tin oxide particles exhibited about 1 log ohm/sq lower surface resistivity than the corresponding layers containing granular tin oxide particles. Examples 1 and Examples 3–5 indicate that the use of acicular conductive metal oxide particles of this invention permits antistatic layers prepared at lower total dry coverage of conductive material to exhibit equivalent or superior conductivity to layers containing granular metal oxides of the prior art. The present Examples also demonstrate additional advantages of the use of acicular, crystalline, conductive metal oxides of this invention. For a fixed dry coverage of 0.60 g/m$^2$, an SER value of 7 log ohm/sq can be obtained for a weight ratio of 50/50 acicular tin oxide/polyurethane binder. However, in order to attain the same SER value using granular tin oxide it is necessary to use a weight ratio of 90/10. Similarly, at a total dry coverage of 0.30 g/m$^2$, the SER value measured for layers containing granular tin oxide particles at a weight ratio of 90/10 can be achieved at a 50/50 weight ratio for layers containing the acicular tin oxide of the present invention. This decrease in weight ratio of conductive acicular metal oxide to polymeric binder required to obtain equivalent conductivity can lead to improved adhesive and cohesive properties for these antistatic coatings. Further, it is anticipated that decreased metal oxide content should result in reduced abrasive wear of tools during finishing operations in manufacturing of imaging elements.

EXAMPLES 12 AND COMPARATIVE EXAMPLES 12 AND 13

Antistatic layers of the present invention containing acicular conductive tin oxide particles dispersed in a polyesterionomer binder (AQ55D) at a weight ratio of 65/35 were prepared at nominal total dry coverages of 0.40, 0.50 and 0.60 g/m$^2$ (Examples 12a–c). The coated layers were processed in KODAK Flexicolor developer solution at 38° C. for 3 minutes and 15 seconds and then rinsed with water and allowed to dry at room temperature. In a similar manner, Comparative Examples 12a–c were prepared using granular conductive tin oxide. Comparative Example 13 was prepared using a weight ratio of binder to amorphous vanadium pentoxide of 97/3 and at a nominal total dry coverage of 0.27 g/m$^2$. SER values were 9.0, 8.6, and 8.1 log ohm/square for Examples 12a–c; and 9.4, 9.3 and 9.3 log ohm/square for Comparative Examples 12a–c, respectively, after processing. After processing, the layer containing amorphous vanadium pentoxide (Comparative Examples 13) was essentially non-conductive. The above examples demonstrate that antistatic layers containing both granular and acicular conductive tin oxide particles remain conductive after wet photographic processing.

EXAMPLES 13–15

The antistatic layers of Examples 3–5 were overcoated with a polyurethane protective topcoat as taught in copending commonly assigned U.S. application Ser. No. 08/576,796 filed Nov. 2, 1995 at a nominal total dry coverage of 1 g/m$^2$. This protective topcoat comprised an aqueous dispersible polyurethane (Witcobond W-232), a polyfunctional aziridine crosslinker, and optional lubricants, matte particles, and coating aids. The resulting transport control backcoatings were evaluated for internal resistivity after overcoating the antistatic layer with the protective topcoat using a wet electrode resistivity (WER) measurement technique (See "Resistivity Measurements on Buried Conductive Layers" by R. A. Elder, pages 251–254, 1990 EOS/ESD Symposium Proceedings). Dry adhesion was evaluated as in Example 1. Wet adhesion was evaluated using a procedure which simulates wet processing of silver halide photographic elements as follows. A one millimeter wide line was scribed into the overcoat layer of a test sample. The sample was then immersed in KODAK Flexicolor developer solution and allowed to soak at 38° C. for 3 minutes and 15 seconds. The test sample was removed from the heated developer solution, placed in another bath containing Flexicolor developer at about 25° C., and a rubber pad (approximately 3.5 cm dia.) loaded with a 900 g weight rubbed vigorously back and forth across the sample in the direction perpendicular to the scribe line. The relative amount of additional material removed is a qualitative measure of the wet adhesion of the various layers. The dry and wet adhesion results, Δ UV and Δ ortho $D_{min}$ values, and internal resistivity values are summarized in Table 2.

EXAMPLES 16–18

The antistatic layers of Examples 3–5 were overcoated with a conventional protective topcoat comprising polymethyl methacrylate (PMMA)(ICI Elvacite 2041), optional matte, and lubricant for transport control function. The topcoat formulation was solvent coated using a dichloromethane solution to produce nominally 1 g/m$^2$ total dry coverage. Dry adhesion and wet adhesion results, Δ UV and Δ ortho $D_{min}$ values and internal resistivities were determined as described hereinabove and are summarized in Table 2.

TABLE 2

| Ex. | Antistatic Layer | Overcoat Type | Dry Adhesion | Wet Adhesion | Δ UV $D_{min}$ | Δ ortho $D_{min}$ | WER (log ohm/square) |
|---|---|---|---|---|---|---|---|
| 13 | 3e | Polyurethane | Excellent | Excellent | 0.015 | 0.004 | 8.5 |
| 14 | 4e | Polyurethane | Excellent | Bxcellent | 0.013 | 0.003 | 8.7 |
| 15 | 5e | Polyurethane | Excellent | Excellent | 0.018 | 0.005 | 6.9 |
| 16 | 3e | PMMA | Excellent | Excellent | 0.016 | 0.004 | 7.7 |
| 17 | 4e | PMMA | Excellent | Excellent | 0.011 | 0.006 | 8.3 |
| 18 | 5a | PMMA | Excellent | Excellent | 0.011 | 0.003 | 8.2 |

PMMA = polymethyl methacrylate

Examples 13–18 demonstrate that antistatic layers comprised of acicular conductive metal oxides can be advantageously combined with protective topcoats or transport control layers which are useful for various types of silver halide photographic imaging elements.

EXAMPLES 19

Antistatic layers were coated to produce nominal total dry coverages of 0.20, 0.30, 0.40, 0.50, and 0.60 g/m$^2$ by applying a coating formulation comprising a weight ratio of tin oxide to gelatin of 70/30 to a primed polyethylene terephthalate support. In addition, 3.5 weight percent 2,3-dihydroxy-1,4-dioxane, based on the weight of gelatin, was added as a hardening agent. Examples 19a–e used acicular tin oxide of the present invention, whereas Examples 19f–j used granular tin oxide. Adhesion results, net ultraviolet and optical densities and surface resistivity values were obtained for the antistatic layers and are given in Table 3. The present Examples demonstrate that conductive acicular tin oxide particles can be dispersed in a water soluble film-forming hydrophilic colloid such as gelatin to produce highly adherent, transparent, conductive layers with lower SER values than those containing granular conductive tin oxide particles of the prior art.

TABLE 3

| Example | Type | Total Dry Coverage g/m$^2$ | Adhesion | Δ UV $D_{min}$ | Δ ortho $D_{min}$ | SER (log ohm/sq) |
|---|---|---|---|---|---|---|
| 19a | invention | 0.20 | Excellent | 0.009 | 0.008 | 6.4 |
| 19b | invention | 0.30 | Excellent | 0.007 | 0.006 | 6.0 |
| 19c | invention | 0.40 | Excellent | 0.012 | 0.003 | 5.8 |
| 19d | invention | 0.50 | Excellent | 0.011 | 0.004 | 5.7 |
| 19e | invention | 0.60 | Excellent | 0.008 | 0.007 | 5.6 |
| 19f | comparative | 0.20 | Excellent | 0.012 | 0.013 | 9.1 |
| 19g | comparative | 0.30 | Excellent | 0.010 | 0.011 | 8.6 |
| 19h | comparative | 0.40 | Excellent | 0.020 | 0.009 | 8.4 |
| 19i | comparative | 0.50 | Excellent | 0.023 | 0.019 | 8.2 |
| 19j | comparative | 0.60 | Excellent | 0.018 | 0.013 | 8.5 |

EXAMPLE 20

Antistatic layers comprised of conductive metal oxide particles and a terpolymer latex of acrylonitrile, vinylidene chloride, and acrylic acid as binder at a weight ratio of conductive metal oxide to binder of 75/25 were coated on to a polyethylene terephthalate web that had been undercoated with a primer layer comprising a terpolymer latex of acrylonitrile, vinylidene chloride, and acrylic acid. The nominal total dry coverage was 0.60 g/m$^2$. For Example 20a the acicular conductive tin oxide of the present invention was used, whereas, for Example 20b granular zinc antimonate particles were used. In order to simulate a full color emulsion package, antistatic layers were overcoated with an optional gelatin-based subbing layer and a thick antihalation layer (AHU) containing black colloidal silver sol. The AHU layer was coated to give a nominal total dry coverage of gelatin of 8 g/m$^2$. Additionally, the AHU layer contained about 2% bisvinylmethane sulfone hardener based on the weight of gelatin. The AHU layer was chill set and aged for 6 days at nominally 70° C. and 50% RH. Dry and wet adhesion results and WER values both before and after processing in Flexicolor developer are given in Table 4.

TABLE 4

| Example | Dry | Wet | WER (log ohm/sq) | |
|---|---|---|---|---|
| Type | Adhesion | Adhesion | Raw | Processed |
| 20a Invention | excellent | good | 7.2 | 8.7 |
| 20b Comparative | excellent | very poor | 7.2 | 8.3 |

These results obtained for Example 20 demonstrate that acicular conductive metal oxide particles can be used effectively in an antistatic layer underlying a photographic emulsion layer. This antistatic layer exhibits excellent conductivity both before and after photographic processing. Furthermore, an antistatic layer containing acicular conductive metal oxide particles of the present invention exhibits superior adhesion to an overlying layer comprising black colloidal silver and gelatin than does one containing granular conductive metal oxide particles of prior art.

While there has been shown and described what are presently considered to be the preferred embodiments of the invention, various modifications and alterations will be obvious to those skilled in the art. All such modifications and alterations are intended to fall within the scope of the appended claims.

What is claimed is:

1. An imaging element for use in an image-forming process; said imaging element comprising a support, an image-forming layer, and an electrically-conductive layer; said electrically-conductive layer comprising a dispersion in a film-forming binder of acicular, crystalline single-phase, conductive metal-containing particles, said particles having a cross-sectional diameter less than or equal to 0.02 μm and an aspect greater than or equal to 5:1.

2. The imaging element of claim 1, wherein the acicular crystalline single phase metal-containing particles comprise a 2 to 70 percent volume fraction of said electrically conductive layer.

3. The imaging element of claim 1, wherein the acicular crystalline single-phase conductive metal-containing particles comprise a 5 to 50 percent volume fraction of said conductive layer.

4. The imaging element of claim 1, wherein the acicular crystalline single-phase conductive metal-containing particles comprise a 40 to 70 percent volume fraction of said conductive layer.

5. The imaging element of claim 1, wherein said particles comprise a dry weight coverage of from 5 to 1000 mg/m$^2$.

6. The imaging element of claim 1, wherein said particles comprise a dry weight coverage of from 10 to 500 mg/m$^2$.

7. The imaging element of claim 1, wherein said electrically conductive layer has a surface resistivity of less than $1\times10^{10}$ ohms per square.

8. The imaging element of claim 1, wherein said electrically conductive layer has a surface resistivity of less than $1\times10^{8}$ ohms per square.

9. The imaging element of claim 1, wherein the acicular, crystalline single-phase, metal-containing particles exhibit a packed powder resistivity of $10^3$ ohm-cm or less.

10. The imaging element of claim 1, wherein the acicular, crystalline single-phase, metal-containing particles are less than 0.05 μm in cross-sectional diameter and less than 1 μm in length.

11. The imaging element of claim 1, wherein the acicular, crystalline single-phase, metal-containing particles are less than 0.02 μm in cross-sectional diameter and less than 0.5 μm in length.

12. The imaging element of claim 1, wherein the acicular, crystalline single-phase, metal-containing particles are less than 0.01 μm in cross-sectional diameter and less than 0.15 μm in length.

13. The imaging element of claim 1, wherein the acicular, crystalline single-phase, metal-containing particles comprise acicular conductive metal oxide particles.

14. The imaging element of claim 1, wherein the acicular, crystalline single-phase, metal-containing particles are acicular doped metal oxides.

15. The imaging element of claim 1, wherein the acicular, crystalline single-phase, metal-containing particles are acicular metal oxides containing oxygen deficiencies.

16. The imaging element of claim 1, wherein the acicular, crystalline single-phase, metal-containing particles comprise acicular doped tin oxide particles.

17. The imaging element of claim 1, wherein the acicular, crystalline single-phase, metal-containing particles comprise acicular antimony-doped tin oxide particles.

18. The imaging element of claim 1, wherein the acicular, crystalline single-phase, metal-containing particles comprise acicular niobium-doped titanium dioxide particles.

19. The imaging element of claim 1, wherein the acicular, crystalline single-phase, metal-containing particles comprise acicular tin-doped indium sesquioxide.

20. The imaging element of claim 1, wherein the acicular, crystalline single-phase, metal-containing particles are acicular metal nitrides, carbides, silicides or borides.

21. The imaging element of claim 1, wherein said film-forming binder comprises a water-soluble polymer.

22. The imaging element of claim 1, wherein said film-forming binder comprises gelatin.

23. The imaging element of claim 1, wherein said film-forming binder comprises a cellulose derivative.

24. The imaging element of claim 1, wherein the film-forming binder comprises a water-insoluble polymer.

25. The imaging element of claim 1, wherein said binder comprises a water-dispersible polyesterionomer.

26. The imaging element of claim 1, wherein said binder comprises a vinylidene chloride-based copolymer.

27. The imaging element of claim 1, wherein said binder comprises a water-dispersible polyurethane.

28. The imaging element of claim 1, wherein said support comprises a poly(ethylene terephthalate) film or a poly (ethylene naphthalate) film.

29. The imaging element of claim 1, wherein said support is surface-treated by means of corona discharge, glow discharge, UV exposure, electron beam treatment, flame treatment, solvent washing, adhesion promoting agents or is overcoated with primer or tie layers containing adhesion-promoting polymers.

30. The imaging element of claim 1, wherein said support comprises a cellulose acetate film.

31. A photographic film comprising:

(1) a support;

(2) an electrically conductive layer which serves as an antistatic layer overlying said support;

(3) a silver halide emulsion layer overlying said electrically-conductive layer; said electrically-conductive layer comprising a dispersion in a film-forming binder of electrically-conductive, acicular, crystalline single-phase, antimony-doped tin oxide particles, said acicular particles having a cross-sectional diameter less than or equal to 0.02 μm and an aspect ratio of greater than or equal to 5:1.

32. A photographic film comprising:

(1) a support;

(2) a silver halide emulsion layer on one side of said support;

(3) an electrically conductive layer which serves as an antistatic backing layer on the opposite side of said support; said electrically-conductive layer comprising a dispersion in a film-forming binder of electrically-conductive, acicular, crystalline single-phase, antimony-doped tin oxide particles, said acicular particles having a cross-sectional diameter less than or equal to 0.02 μm and an aspect ratio of greater than or equal to 5:1.

33. A photographic film comprising:

(1) a support;

(2) a silver halide emulsion layer on one side of said support;

(3) an electrically-conductive layer which serves as an antistatic layer on the opposite side of said support;

(4) an abrasion-resistant backing layer overlying said electrically-conductive layer; said electrically-conductive layer comprising a dispersion in a film-forming binder of electrically-conductive, acicular, crystalline single-phase, antimony-doped tin oxide particles, said acicular particles having a cross-sectional diameter less than or equal to 0.02 μm and an aspect ratio of greater than or equal to 5:1.

34. A photographic film comprising:

(1) a support;

(2) a silver halide emulsion layer on one side of said support;

(3) an electrically-conductive layer which serves as an antistatic layer on the same side of said support;

(4) an antihalation layer overlying said electrically-conductive layer; said electrically-conductive layer comprising a dispersion in a film-forming binder of electrically-conductive, acicular, crystalline single-phase, antimony-doped tin oxide particles; said acicular particles having a cross-sectional diameter less than or equal to 0.02 μm and an aspect ratio of greater than or equal to 5:1.

* * * * *